United States Patent [19]

Fairley

[11] Patent Number: 4,923,234

[45] Date of Patent: May 8, 1990

[54] CUTLERY IMPLEMENT INCLUDING SPRING BIASED ADJUSTABLE CLAMPING JAWS FOR HOLDING FOOD ITEMS

[76] Inventor: Kirkpatric Fairley, 4291 Garthwaite, Los Angeles, Calif. 90008

[21] Appl. No.: 343,491

[22] Filed: Apr. 26, 1989

[51] Int. Cl.[5] ..... A47G 21/10; A47J 43/28

[52] U.S. Cl. ..... 294/99.2; 294/5; 294/902

[58] Field of Search ..... 294/2, 3, 5, 7, 8, 8.5, 294/11, 25, 33, 99.1, 99.2, 902; 30/142, 150, 322

[56] References Cited

U.S. PATENT DOCUMENTS

| | | | |
|---|---|---|---|
| 385,498 | 7/1888 | Brinton | 294/99.2 |
| 557,782 | 4/1896 | Eccles | 294/5 |
| 568,237 | 9/1896 | Carley | 294/5 |
| 738,154 | 9/1903 | Brinkmann | 294/11 |
| 1,011,597 | 12/1911 | Fischler | 294/99.2 X |
| 1,030,729 | 6/1912 | Horton | 294/5 |
| 1,539,669 | 5/1925 | Hauser | 294/5 |
| 2,585,089 | 2/1952 | Caldwell et al. | 294/99.2 X |
| 2,999,713 | 9/1961 | Jones | 294/5 |
| 3,794,368 | 2/1974 | Majeske | 294/5 |
| 3,805,384 | 4/1974 | Falcone | 294/5 X |
| 3,995,902 | 12/1976 | Sciaino, Jr. | 294/5 |
| 4,802,704 | 2/1989 | Burns | 294/25 X |

FOREIGN PATENT DOCUMENTS

| | | | |
|---|---|---|---|
| 2415955 | 10/1975 | Fed. Rep. of Germany | 294/99.2 |
| 2414892 | 9/1979 | France | 294/99.2 |

*Primary Examiner*—Johnny D. Cherry
*Attorney, Agent, or Firm*—Jerry T. Kearns

[57] ABSTRACT

A cutlery implement for use in holding food items during eating is designed specifically for use with barbecued ribs. The cutlery implement has a spring steel wire frame having two crossing frame members which form opposite ends of a torsional coil spring. A pair of juxtaposed grasping jaws are provided on free ends of the frame members for clamping a food item. A pair of handles are provided at intermediate portions on the frame members for manually opening the gripping jaws and for manipulating the held food item. The gripping jaws may be secured to the frame members by an adjustable threaded connection to allow adjustment of the jaw separation for use with various different dimensioned food items. The gripping jaws may have aligned concave grasping surfaces or planar grasping surfaces provided with friction enhancing pointed projections.

1 Claim, 2 Drawing Sheets

CUTLERY IMPLEMENT INCLUDING SPRING BIASED ADJUSTABLE CLAMPING JAWS FOR HOLDING FOOD ITEMS

BACKGROUND OF THE INVENTION

1. Field of the Invention

The present invention relates to cutlery implements, and more particularly pertains to a food grasping tong designed specifically for use in handling and eating barbecued ribs. Barbecued ribs are typically served covered with a barbecue sauce which is somewhat sticky and messy to handle. Conventionally, these ribs are manually grasped in the fingers of the consumer during eating. In order to provide a neater method of eating these flavorful but messy ribs, the present invention provides a specially designed food grasping tongs for grasping and manipulating a barbecued rib while it is being eaten.

2. Description of the Prior Art

Various types of cutlery implements for grasping food items during eating are known in the prior art. A typical example of such a cutlery implement is to be found in U.S. Pat. No. 1,539,669, which issued to E. Hauser on May 26, 1925. This patent discloses a pair of insertion forks having manual grasping handle portions and which are adapted for insertion into opposite ends of an ear of corn. U.S. Pat. No. 2,999,713, which issued to J. Jones on Sept. 12, 1961, discloses a corn ear grasping implement having a wire frame with spring biased pivotal opposed grasping jaws. U.S. Pat. No. 3,794,368, which issued to J. Majeske on Feb. 26, 1974, discloses a cork screw tYpe insertion implement for use in eating an ear of corn. U.S. Pat. No. 3,805,384, which issued to A. Falcone on Apr. 23, 1974, discloses a hand manipulated tool for grasping and removing kernels from an ear of corn. U.S. Pat. No. 3,995,902, which issued to B. Sciaino, Jr. on Dec. 7, 1976, discloses a pair of insertion spikes for insertion into opposite ends of an ear of corn which are receivable in telescoping relation during storage.

While the above mentioned devices are directed to cutlery implements for grasping food items, none of these devices disclose a food grasping tongs having a spring steel wire frame with crossing frame members forming opposite ends of a torsional coil spring and having juxtaposed clamping jaws. Additionally, none of the aforesaid devices disclose a food grasping tongs with clamping jaws having an adjustable separation and provided with friction enhancing projections. Inasmuch as the art is relatively crowded with respect to these various types of cutlery implements, it can be appreciated that there is a continuing need for and interest in improvements to such cutlery implements, and in this respect, the present invention addresses this need and interest.

SUMMARY OF THE INVENTION

In view of the foregoing disadvantages inherent in the known types of cutlery implements now present in the prior art, the present invention provides an improved cutlery implement. As such, the general purpose of the present invention, which will be described subsequently in greater detail, is to provide a new and improved cutlery implement which has all the advantages of the prior art cutlery implements and none of the disadvantages.

To attain this, representative embodiments of the concepts of the present invention are illustrated in the drawings and make use of a cutlery implement for use in holding food items during eating designed specifically for use with barbecued ribs. The cutlery implement has a spring steel wire frame having two crossing frame members which form opposite ends of a torsional coil spring. A pair of juxtaposed grasping jaws are provided on free ends of the frame members for clamping a food item. A pair of handles are provided at intermediate portions on the frame members for manually opening the gripping jaws and for manipulating the held food item. The gripping jaws may be secured to the frame members by an adjustable threaded connection to allow adjustment of the jaw separation for use with various different dimensioned food items. The gripping jaws may have aligned concave grasping surfaces or planar grasping surfaces provided with friction enhancing pointed projections.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cutlery implement which has all the advantages of the prior art cutlery implements and none of the disadvantages.

It is another object of the present invention to provide a new and improved cutlery implement which may be easily and efficiently manufactured and marketed.

It is a further object of the present invention to provide a new and improved cutlery implement which is of a durable and reliable construction.

An even further object of the present invention is to provide a new and improved cutlery implement which is susceptible of a low cost of manufacture with regard to both materials and labor, and which accordingly is then susceptible of low prices of sale to the consuming public, thereby making such cutlery implements economically available to the buying public.

Still yet another object of the present invention is to provide a new and improved cutlery implement which provides in the apparatuses and methods of the prior art some of the advantages thereof, while simultaneously overcoming some of the disadvantages normally associated therewith.

Still another object of the present invention is to provide a new and improved cutlery implement to facilitate manual manipulation of barbecued ribs during consumption.

Yet another object of the present invention is to provide a new and improved cutlery implement in the form of food grasping tongs having juxtaposed clamping jaws with an adjustable separation for use with various different dimensioned food items.

Even still another object of the present invention is to provide a new and improved cutlery implement having adjustable clamping jaws for selectively grasping a barbecued rib from end to end or by only one end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
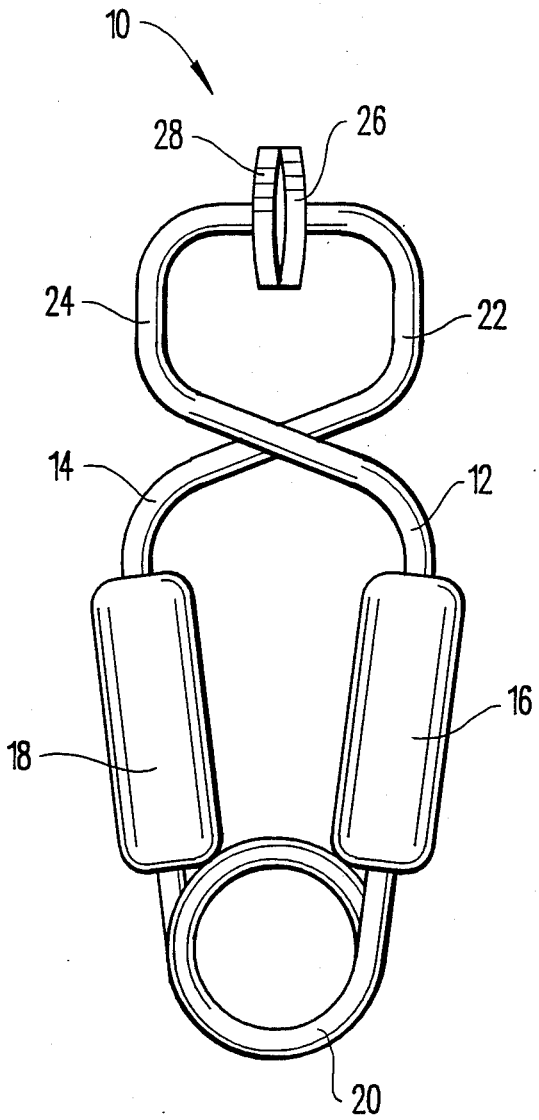
FIG. 1 is a front view illustrating the cutlery implement according to a first embodiment of the present invention.

With reference now to the drawings, and in particular to FIG. 1 thereof, a new and improved cutlery implement embodying the principles and concepts of the present invention and generally designated by the reference numeral 10 will be described.

More specifically, it will be noted that the first embodiment 10 of the invention includes a frame formed from spring steel wire, preferably fourteen gauge type 304 stainless, which is bent into the illustrated approximately FIG. 8 configuration. The frame includes a torsional coil spring portion 20 having opposite ends forming frame members 12 and 14. The frame members 12 and 14 cross in overlying relation and have free end portions 22 and 24 provided with respective grasping jaws 26 and 28. The juxtaposed grasping jaws 26 and 28 have facing grasping surfaces which are formed by metal plates bent into a slightly concave curvature, as shown. Plastic circular handle portions 16 and 18 are formed on the frame members 12 and 14 to facilitate manual manipulation of the cutlery implement and to allow the grasping jaws 26 and 28 to be manually moved to an open position. The torsional coil spring 20 provides a spring bias which maintains the grasping jaws 26 and 28 in the illustrated closed position.

Figure 2:
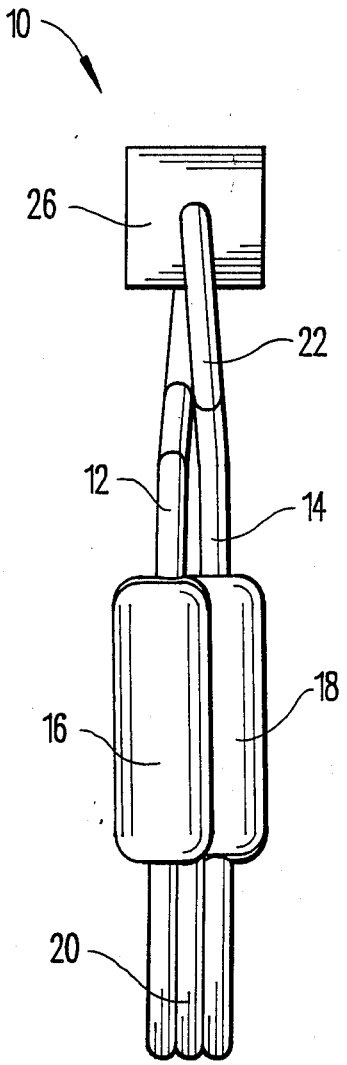
FIG. 2 is a side view of the cutlery implement of FIG. 1.

FIG. 2 is a side view which further illustrates the construction of the cutlery implement 10 of FIG. 1.

Figure 3:
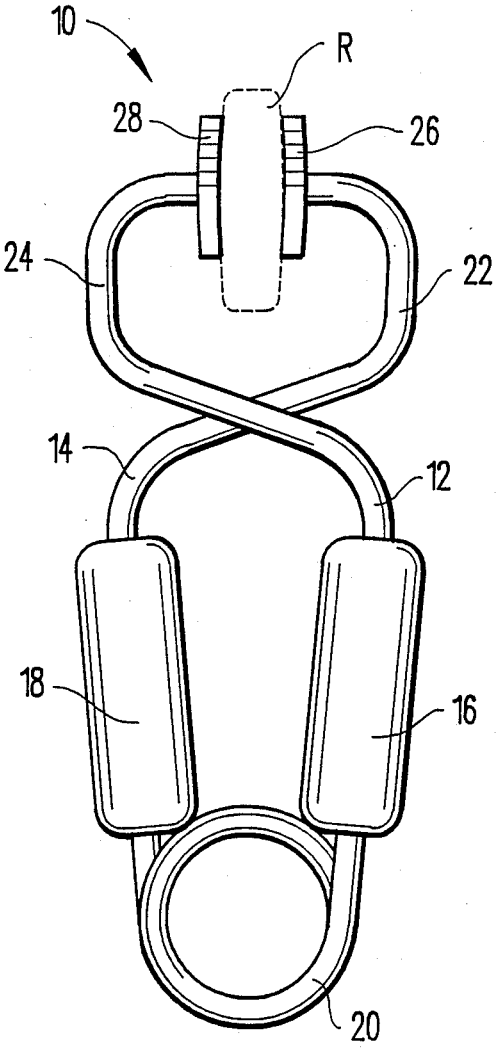
FIG. 3 is a side view of the cutlery implement of FIG. 1, illustrating a food item grasped between the clamping jaws.

As shown in FIG. 3, a food item, such as a barbecued rib R, may be held between the jaws 26 and 28 during consumption. The handles 16 and 18 are preferably formed from a dishwasher safe plastic material to enable convenient cleaning of the cutlery implement 10 after use. As may now be understood, the cutlery implement 10 permits ordinarily messy barbecued ribs R to be consumed without soiling the fingers and hands of the consuming individual.

Figure 4:
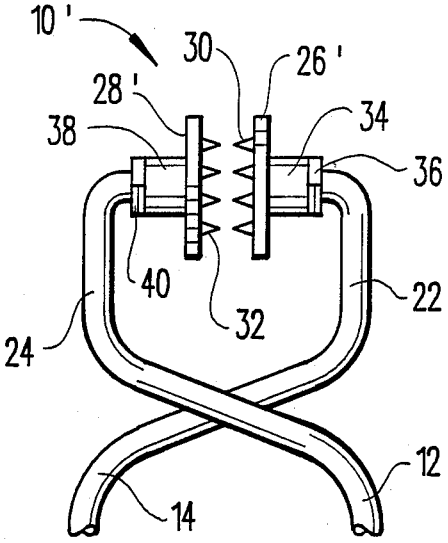
FIG. 4 is a partial side view, illustrating adjustable clamping jaws of a cutlery implement according to a second embodiment of the present invention.

FIG. 4 is illustrates a slightly modified second embodiment 10' of the present invention, formed identically as illustrated and described with reference to FIGS. 1 through 3, with the exception of the grasping jaws 26' and 28'. The grasping jaws 26' and 28' are each formed from a planar disk provided with respective pointed projections 30 and 32 for frictional engagement with a food item. A cylindrical centrally threaded sleeve 34 and 38 is centrally secured to an outer face of each of the jaws 26' and 28' and is utilized to form an adjustable threaded connection with the respective end portions 22 and 24 of the wire frame. Position locking nuts 36 and 40 are utilized to secure the clamping jaws 26' and 28' in a selected adjusted position.

Figure 5:
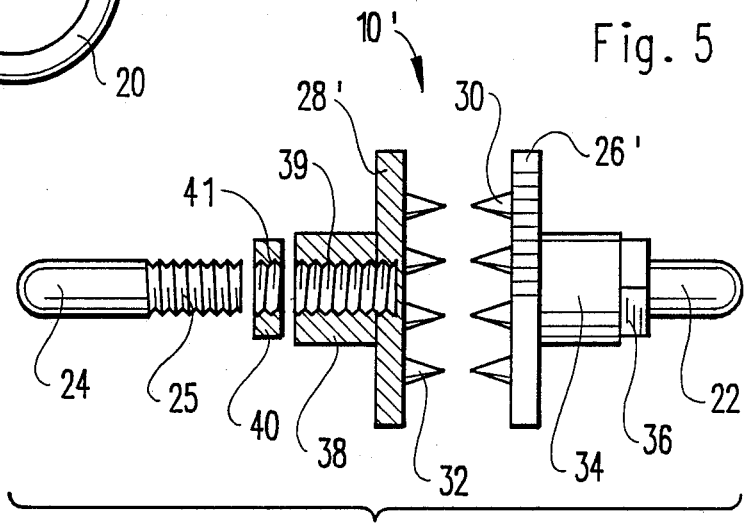
FIG. 5 is a detail view, partially in cross section, further illustrating the construction of the adjustable clamping jaws of the cutlery implement of FIG. 4.

FIG. 5 is a detail view, partially in cross section, which illustrates the internally threaded blind bore 39 of the sleeve 38 together with the threaded bore 41 of the lock nut 40. As shown, the distal end portion 25 of the frame member 24 is threaded, to allow engagement with the lock nut 40 and sleeve 38. As may now be understood, the separation of the clamping jaws 26' and 28' may be adjusted by virtue of these threaded connections. The spring steel wire frame is preferably configured to provide abutting engagement between the jaws 26' and 28', when both of the jaws are adjusted for minimum separation. Thus, when the jaws are configured for a greater separation, they will be slightly spaced when biased to their fully closed position. By appropriate adjustment, the cutlery implement 10' may be utilized with a wide variety of different dimensioned food items, and may be particularly adjusted for use in grasping short ribs by both opposite ends thereof, or for use in grasping only one end.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cutlery implement for holding a food item, comprising:

a frame formed from spring steel wire;

said frame having two frame members forming opposite ends of a torsional coil spring;

said frame members crossing each other in overlying relation and each having a free end portion provided with juxtaposed clamping jaws;

said torsional coil spring biasing said jaws to a closed position;

said frame member free end portions disposed in coaxial alignment in said closed position;

a handle secured on each of said frame members for manually moving said jaws to an open position;

each of said jaws including an internally threaded cylindrical sleeve secured centrally on a back face of a planar disk;

each of said frame member free end portions having an external thread in engagement with said internally threaded sleeve of a respective clamping jaw to enable manual adjustment of clamping jaw separation;

a lock nut on each of said frame member free end portions to maintain said clamping jaws in a selected adjusted position;

and a plurality of pointed projections on facing grasping surfaces of each of said planar disks to enhance frictional engagement with a food item.

* * * * *